United States Patent [19]

Mizelle

[11] Patent Number: 4,675,927

[45] **Date of Patent: * Jun. 30, 1987**

[54] BEDDING UNITS AND SPRINGS THEREFOR

[76] Inventor: Ned W. Mizelle, P.O. Box 5985, High Point, N.C. 27262

[ * ] Notice: The portion of the term of this patent subsequent to Dec. 24, 2002 has been disclaimed.

[21] Appl. No.: 721,728

[22] Filed: Apr. 10, 1985

Related U.S. Application Data

[63] Continuation-in-part of Ser. No. 532,137, Sep. 14, 1983, Pat. No. 4,559,654.

[51] Int. Cl.[4] ..... A47C 23/02

[52] U.S. Cl. ..... 5/247; 5/255; 5/253; 5/261; 5/264 R; 5/268

[58] Field of Search ..... 5/247, 253, 255, 261, 5/262, 264 R, 264 B, 265, 268, 474; 267/85, 86, 102–109

[56] References Cited

U.S. PATENT DOCUMENTS

| | | | |
|---|---|---|---|
| 232,390 | 9/1880 | Clippinger | 5/268 |
| 639,795 | 12/1899 | Treadway et al. | 5/268 |
| 2,886,311 | 5/1959 | Flint | 267/144 |
| 3,200,417 | 8/1965 | Costello | 5/201 |
| 3,305,879 | 2/1967 | Krakaner | 5/261 |
| 3,680,157 | 8/1972 | Slominski et al. | 5/247 |
| 3,825,960 | 7/1974 | Inman et al. | 5/247 |
| 4,510,635 | 4/1985 | Woffendin | 5/255 |
| 4,559,654 | 12/1985 | Mizelle | 5/247 |

*Primary Examiner*—Gary L. Smith
*Assistant Examiner*—Michael F. Trettel
*Attorney, Agent, or Firm*—Beveridge, DeGrandi and Weilacher

[57] ABSTRACT

A bedding unit spring has an upper portion attached to a grid, a lower portion attached to a frame, and a vertically collapsible midportion which connects the upper portion to the lower portion. The upper portion of a spring may have two transverse bars at its ends, a third transverse bar at its center, and a center bar formed of two sections which are on opposite sides of the third transverse bar. The center bar sections are directed toward the midportions of the end transverse bars. A deflection limiter member is attached to the spring to limit the collapsing movement of the spring and to increase the effective stiffness of the spring. It is formed of a wire which has an abutment portion and two connector bar portions. The connector bar portions extend at different inclination angles from the abutment portion to the spring. In embodiments where the ends of the spring wire are located in the upper portion of the spring, the lower portion has a foot which in connectible to the frame, and the midportion has two lower connector bars which extend outwardly from the foot in opposite directions. The upper portion has two spaced apart center bar sections directed toward the midportions of two transverse bars, the latter being located either between or on opposite sides of the center bar sections. In versions where an end of the spring wire is in the lower portion of the spring, the spring has a foot which is insertable and lockable in a hollow metal slat. The end of the spring wire is at the trailing end of the foot during insertion. When this trailing end passes beyond the slot it moves resiliently outwardly to a position where it confronts the interior surface of the slot to lock the foot in position.

26 Claims, 15 Drawing Figures

FIG. 6
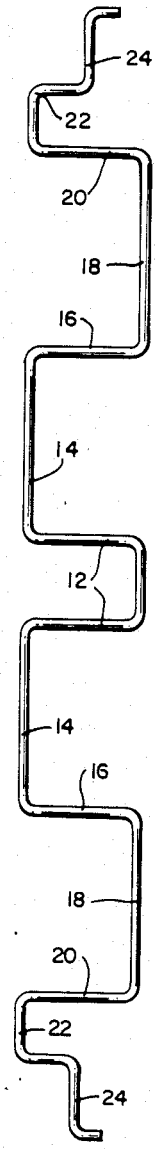
FIG. 13
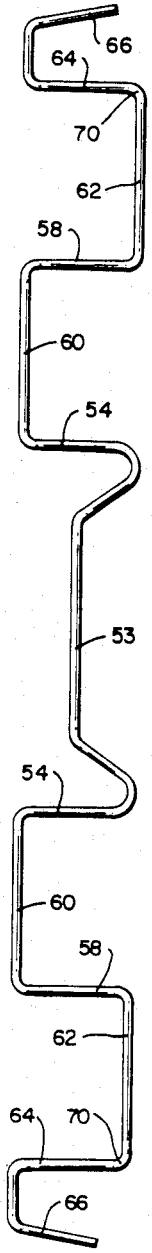
FIG 7
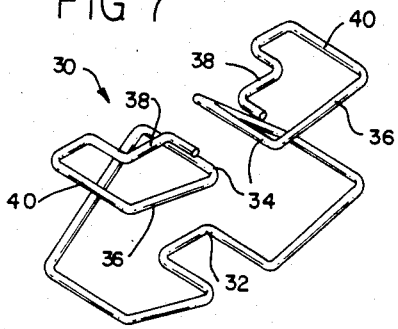
FIG. 8
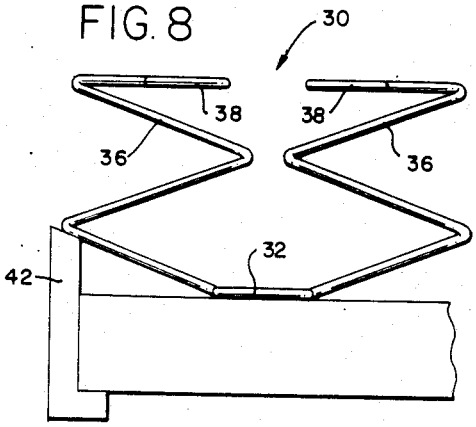
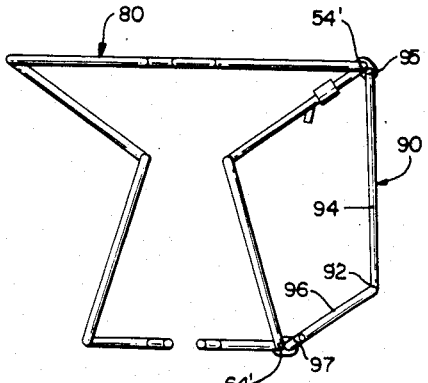
FIG. 15

FIG. 9
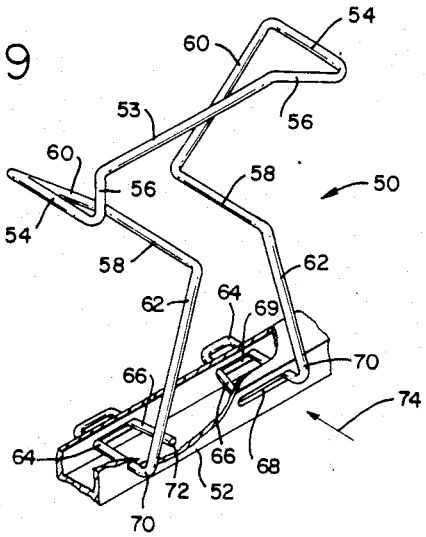
FIG. 11
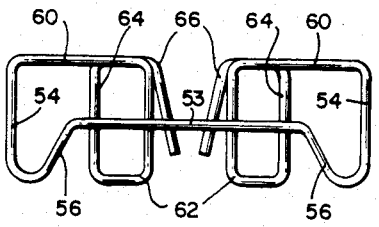
FIG. 10
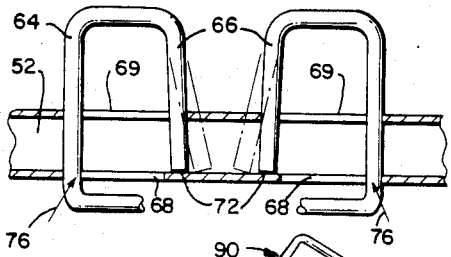
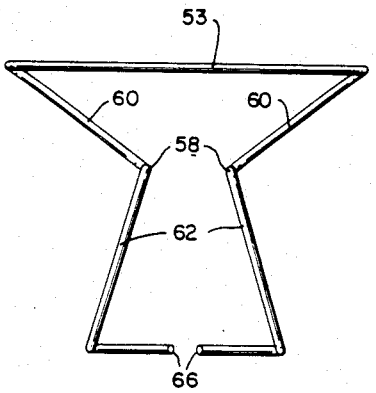
FIG. 12
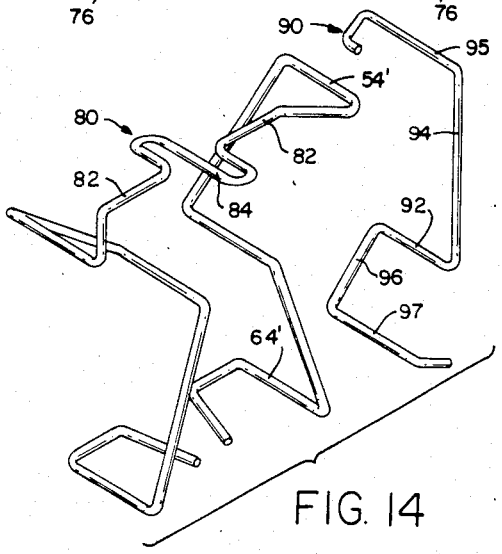
FIG. 14

BEDDING UNITS AND SPRINGS THEREFOR

REFERENCE TO RELATED APPLICATION

This is a continuation-in-part of U.S. patent application Ser. No. 532,137, filed Sept. 14, 1983, now U.S. Pat. No. 4,559,654 for Bedding Units and Components for Such Units. The entirety of this earlier application is incorporated herein by reference.

BACKGROUND OF THE INVENTION

This invention relates to bedding units and to springs which are used in such units.

Traditionally, box spring units have been manufactured of many helical coils which support an upper deck on a lower frame member. More recently, many manufacturers have adopted a construction which, in lieu of coil springs, utilizes nonspiral formed wire springs which have horizontal torsion bars with opposite ends connected to upwardly and downwardly inclined connector bars. Examples of bedding units manufactured with formed wire springs are classified in U.S. Class 5, Subclasses 247 and 255.

In my earlier U.S. patent application Ser. No. 532,137, filed Sept. 14, 1983, now U.S. Pat. No. 4,559,654, a number of improved springs are disclosed and claimed. These springs represent significant advantages with respect to the versatility of spring placement, the manner in which the deflection of the springs was limited, and the general characteristics which made the springs desirable in bedding units.

The invention described in this application has many of the attributes of the springs disclosed in the aforementioned U.S. patent application Ser. No. 532,137 now U.S. Pat. No. 4,559,654. Further, this specification discloses a number of variations, modifications and improvements.

In one respect, the springs described in this specification are particularly well suited for the construction of bedding units which have frames with transverse metal slats. The invention presents different foot configurations which are effective to attach the springs to the frame and provide for proper balance and load distribution.

In another respect, the invention described in this specification represents an improvement to the previously disclosed devices in that the upper portion of a spring may have three transverse bars rather than two, and the center longitudinal bar can be formed of two sections which are on opposite sides of the central transverse bar and are directed toward the midportions of the end transverse bars. This configuration is desirable because it provides for greater versatility. The central transverse bar can be connected to a longwire of the grid in a balanced condition, and the sections of the center longitudinal bar can be connected to the crosswires of the grid.

According to another disclosed feature, the deflection limitations and/or the effectiveness of a spring can be varied. These effects can be produced by a deflection limiting member which is formed of wire and is attached to two spaced apart locations on the spring.

Among the many objects of this invention are to provide springs in bedding units which are suitable for their intended purposes, reasonably priced, and durable.

SUMMARY OF THE INVENTION

This invention relates to bedding units and to springs which are used in such units. Typically, the springs are mounted on slats in the frame of a box spring unit, and a wire grid is connected to the upper portions of the springs. Each spring is formed of a single resilient wire which has a lower portion connectible to the frame, a substantially horizontal upper portion connectible to the wire grid, and a midportion connecting the lower portion to the upper portion. The midportion is vertically collapsible to support the upper portion resiliently on the lower portion.

In one respect, the invention involves a spring and bedding unit of the type described above wherein the lower portion of a spring has a single mounting foot which preferably is centrally located. The mounting foot is connectible to the frame, and the vertically collapsible midportion of the spring has two lower connector bars which extend outwardly from the foot in opposite directions. Preferably, the foot is U-shaped, and the bedding unit has different springs which have their feet extending in opposite directions so that the attachment of these springs to the grid maintains the spring feet in a spaced relationship to prevent their removal from the slats. The vertically collapsible midportion of the spring preferably includes torsion bars which extend transversely from the lower connector bars, and upper connector bars which extend inwardly from the torsion bars in opposite directions. Also, the upper portion of the spring preferably has a pair of transverse bars and a pair of longitudinal bars which are clippable to a wire grid. These longitudinal bars are directed toward midportions of the transverse bars, and the upper portion also has a pair of connecting sections which extend from one end of a center bar to one end of a transverse bar.

In another respect, the invention involves bedding units and springs therefor in which the springs are provided with feet which are designed to engage lockably in hollow metal slats. According to this feature of the invention, the lower portion of the spring has a foot formed of first and second wire portions which are resiliently connected to each other. These wire portions, preferably having a U-shaped relationship, are inserted together into a slot in a hollow slat. The trailing end of the first wire portion has a bend which connects the foot to the vertically collapsible midportion of the spring; and, the trailing end of the second wire portion of the foot is an end of the spring wire. The latter end is located forwardly of the bend with respect to the insertion directions so that, during insertion, the first wire portion remains in the slot when the trailing of the second wire portion passes beyond the slot. The second wire portion is then released in order to move resiliently outwardly to a position where it confronts an interior surface of the slat. This locks the foot in position. Preferably, the halves of the spring which lie on opposite sides of the central transverse vertical plane thereof are substantially mirror images of each other.

Another feature of the invention pertains to a spring and bedding unit in which the upper portion of the spring has a configuration which renders it particularly suitable for being connected either to longwires or crosswires of the wire grid. In this respect, the substantially horizontal upper portion of the spring has a longitudinally oriented center bar and a pair of transverse bars. The center bar is spaced from the transverse bars at a position where the center bar is directed toward midportions of the transverse bars, and the upper portion also has a pair of connecting sections which connect the ends of the center bar to the ends of the transverse bars. The characterizing feature in this structure is that the center bar has two sections which are spaced from each other and are connected together by a section of wire which has a third transverse bar therein. The third transverse bar is capable of being connected to longwires of the grid, and the center bar is capable of being clipped to transverse wires of the grid.

Another feature of the invention involves bedding units and springs in which the substantially horizontal upper portion of the spring has a center bar formed to two spaced apart center bar sections, and these center bar sections are spaced from and directed toward midportions of the transverse bars. Connecting sections extend from one end of a center bar section to one end of a transverse bar. The characterizing feature in this particular construction is that the transverse bars are located between the center bar sections rather than vice versa.

This invention also pertains to a bedding unit and springs in which deflection limiter members are attached to the springs to limit the collapsing movement of the midportion of the springs. More specifically, the deflection limiter is a piece of wire bent to provide an abutment portion and two connector bars. The connector bars extend from the abutment portion to the spring at different inclination angles, and these connector bars are attached to the spring at different elevations. The abutment portion moves downwardly when the spring collapses vertically so that collapsing movement of the spring is stopped when the abutment portion contacts an object in its path. Preferably, the deflection limiter member also acts as a booster or stiffener to increase the spring rate. To achieve this, the connector bars of the deflection limiter member are connected to two locations on the spring which are spaced apart by a distance which changes in response to vertical collapsing movement of the spring. The collapsing movement of the spring deforms the deflection limiter member by moving the connector bars thereof. Due to the resilience of the deflection limiter member, it increases the effective stiffness of the spring to which it is attached.

Persons familiar with the art will recognize or discover that the invention has other important characteristics and attributes. For a further understanding of the invention, reference is made to the accompanying drawings and to the following detailed description.

BRIEF DESCRIPTION OF THE DRAWINGS

FIG. 6 is a view of the fabric used for making the spring illustrated in FIGS. 1–4.

FIG. 7 is an isometric view of a modified spring suitable for use in connection with the structure shown in FIG. 1.

FIG. 8 is a front view of the spring of FIG. 7.

FIG. 9 is a fragmentary isometric view of a second embodiment of the invention.

FIG. 10 is an enlarged fragmentary plan view showing the slat and the lower attachment portions of the spring illustrated in FIG. 9.

FIGS. 11 and 12 are top and front views, respectively, of the spring shown in FIG. 9.

FIG. 13 is a view of a fabric for making the spring of FIG. 9.

FIG. 14 is an exploded isometric view showing a modified version of a spring suitable for use in the unit shown in FIG. 9, said spring also having a deflection limiter member associated therewith for limiting deflection and for increasing the effective stiffness of the spring.

FIG. 15 is a front view of the structure shown in FIG. 14, with the deflection limiter member being clipped to the spring.

DETAILED DESCRIPTION

All structures disclosed in this specification are used in connection with bedding units such as box springs. Such units typically have welded wire grids connected to the horizontal upper portions of the springs, and a frame provided with slats which support the lower portions of the springs. Each spring has a vertically collapsible resilient midportion which connects its lower portion to its upper portion.

Although the springs are all capable of being connected to the slats or other members of a conventional wooden frame by means of staples, the springs are also particularly suited for use in connection with bedding units which have hollow metal slats.

Figure 1:
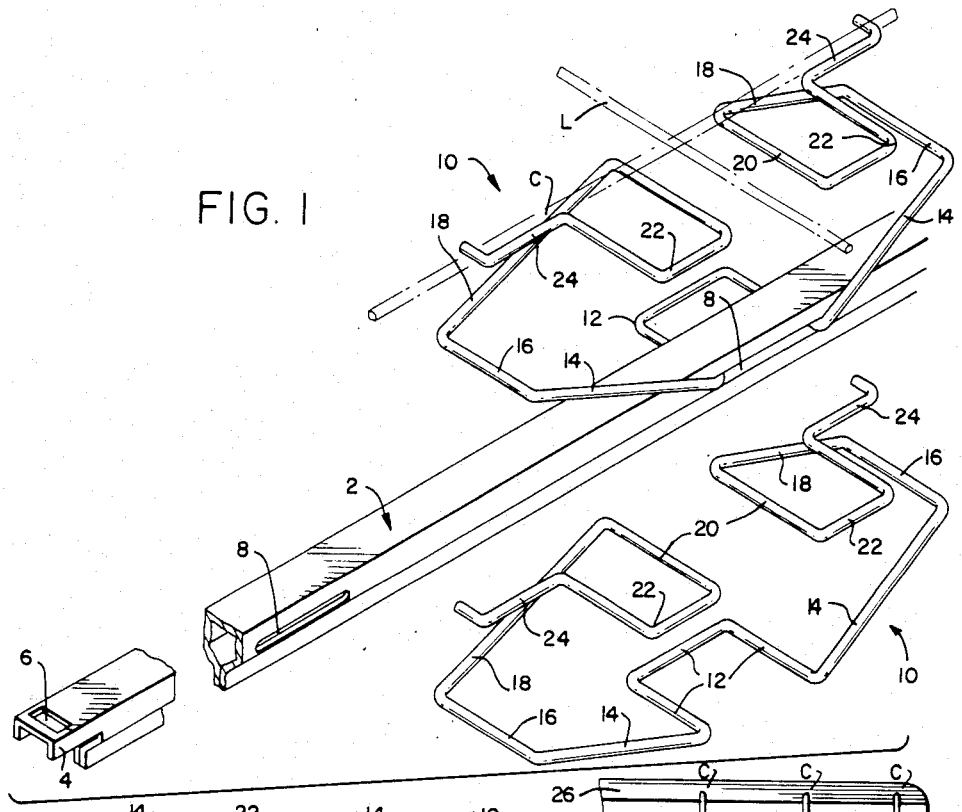
FIG. 1 is an exploded perspective view illustrating a first embodiment of the invention.
Figure 2:
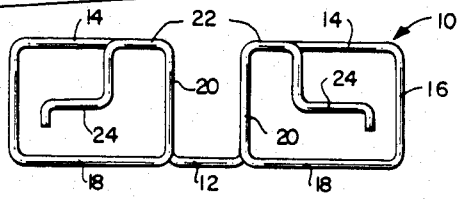
FIGS. 2, 3 and 4 are top, side and end views, respectively, of the spring shown in FIG. 1.

FIG. 1 shows such a hollow metal slat 2. The slat 2 is tubular and it has a cross section which in its upper region is of an inverted U-shape and in its lower region is of an upright Y-shape. The adjacent legs of the Y-shaped region are welded together to provide a rigid, effective and relatively economic unit. At the end of the slat, there is an extension 4 of U-shaped cross section which has a square opening 6 in its upper horizontal surface in order to receive staples or fasteners suitable for attaching the slat to the siderails of the frame. The slat has a plurality of elongated horizontal slots 8 which extend through both sides of the slat.

The springs 10 utilized in the unit of FIG. 1 have, as is customary, a substantially horizontal upper portion which is connected to a wire grid, a lower portion which is connectible to a slat of the frame, and a vertically collapsible resilient midportion which supports the upper spring portion on the lower spring portion. The lower portion of the spring comprises a centrally located foot 12 which is connectible to slat 2 of the frame. This foot 12 is U-shaped and it is insertable through two aligned slots 2 so that it extends entirely through the slat. The vertically collapsible midportion of the spring is formed of a pair of lower connector bars 14 which extend outwardly from the foot in opposite directions, a pair of torsion bars 16 which extend transversely from the connector bars, and a further pair of connector bars 18 which extend at an upward inclination from the torsion bars 16 to the upper attachment portion of the spring. This attachment portion is provided with horizontal torsion bars 20, connection sections 22, and a center bar formed of two spaced-apart center bar sections 24. The transverse bars are located between the center bar sections 24, and the center bar sections 24 are directed toward the midportions of the transverse bars 20. As will be appreciated by persons skilled in the art, the center bar sections 24 are clippable by conventional bedding clips to crosswires C which, together with longwires L form the welded wire grid of the bedding unit.

Figure 5:
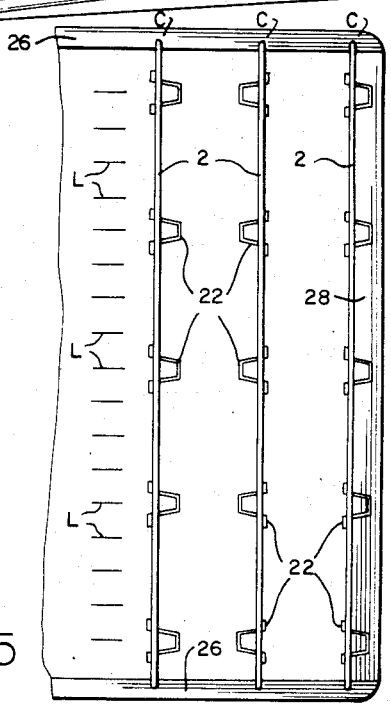
FIG. 5 is a diagramatic plan view of portions of a bedding unit constructed according to the first embodiment of the invention.

As can be seen in FIG. 5, the slats 2 are attached to a wooden frame which has siderails 26 and end rails 28. Different springs have their feet 20 extending in opposite directions so that the attachment of the springs to the grid maintains the feet of the springs in a spaced relationship to prevent their removal from the slats. It is also possible to insert the springs in opposite directions on each rail to achieve this result.

Figure 3:
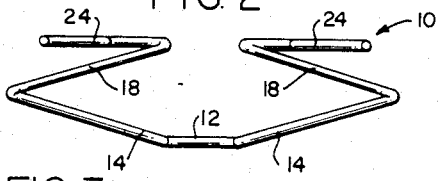
Figure 4:
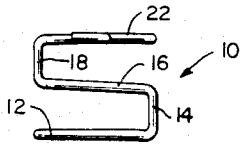

An inspection of FIG. 3 will reveal that the spring does not have any internal structure which limits its deflection, i.e. it is constructed so that the upper portion is resiliently displaceable to a collapsed position where it is substantially adjacent to the lower portion. The angles, distances and characteristics of the wire used are such that after such collapsing movement, the upper portion will resiliently return from its collapsed position to its original height. A spring having the characteristics described in this paragraph is referred to herein as a full deflection spring.

Another characteristic of the springs shown in FIGS. 1–4 is that they have a mirror image configuration. This term is used in this specification to describe springs which are formed of two halves which are substantially mirror images of each other and are located on opposite sides of a central transverse vertical plane which bisects the spring.

A modified mirror image full deflection spring 30 with a centrally located U-shaped attachment foot 32 is shown in FIGS. 7 and 8. In this embodiment, there are additional torsion bars 34 and additional connector bars 36 with respect to the springs illustrated in FIGS. 1–4. Also, the upper portion of the spring 30 has its center bar sections 38 located between the transverse bars 40 rather than on opposite sides thereof. The spring of FIGS. 7 and 8 can be used in lieu of the springs shown in FIG. 1.

Any of the springs shown in FIGS. 1–8 can be stapled or otherwise attached to the components of a wooden frame. The springs can be constructed of a relatively low height in comparison to springs currently used in box spring construction, and it is possible to use them on a frame which has a greater height than is conventional. Such a frame may be constructed, for example, by orienting wooden slats on edge so that they have a greater height than thickness. Such an arrangement is shown in FIG. 8, where it will also be seen that the frame has an upper extension or abutment 42 which lies against one of the lower torsion bars of the spring 30. This abutment will disable a portion of the left side of the spring, causing it to be stiffer than the right side of the spring. This arrangement may be desirable, for example, when an increased stiffness is desired near the edges of the bedding unit in contrast to the central areas thereof.

Additional features of the invention are utilized in the embodiments illustrated in FIGS. 9–15. Referring to FIG. 9, it will be seen that spring 50 of the mirror image type is attached to a metal slat 52. The upper portion of the spring 50 has a continuous longitudinally oriented center bar 53, the ends of which are spaced from and directed toward the midportions of the transverse bars 54. Connecting sections 56 extend from the ends of the center bar 53 to the ends of the transverse bars 54. The collapsible midportion of the spring is formed of torsion bars 58 which are connected to the upper and lower portions of the spring by connector bars 60 and 62, respectively. The lower portion of the spring has two feet which are locked in the slat so that the spring is firmly retained in position in the unit. Each foot is formed of wire portions 64 and 66 which are resiliently connected to each other and are insertable together into the slots 68 and 69 of the slat 52. The trailing end of the first wire portion 64 has a bend 70 which connects the foot to the connector bar 62, and the trailing end of the second wire portion 66 is the end surface 72 of the spring wire. This end surface 72 is located forwardly of the bend 70 with respect to the insertion direction represented by arrow 74. During insertion, while the first wire portion 64 is in the entry slot 68, the trailing end 72 of the second wire portion 66 passes beyond the entry slot 68. Its configuration and resilience are such that, after passing beyond the slot 68, the second wire portion moves outwardly to a position where it confronts an interior surface of the slat to lock the foot in position. This sequence of operations will be understood readily from FIG. 10 in which the broken line positions show the relaxed configuration of the foot. When the foot of the spring is locked to the slat 52, the resilience of the wire portions 64 and 66 cause them to bear firmly against both ends of the exit slot 69. The wire portion 64 is resiliently biased into contact with one end of the entry slot 68 whereas the bend 70 binds in the entry slot 68 in the direction represented by the arrow 76. The end surface 72 of the spring wire bears against the interior surface of the slat so that the foot is locked in position. As will be evident from FIG. 10, the geometry of this connection is such that the foot is mechanically locked in place so that forces which are opposite to the insertion direction 74 cannot remove the foot from the slat.

The spring-to-slat connection illustrated in FIGS. 9 and 10 is particularly desirable as it provides a secure connection, it is very easily performed and, when necessary, the spring is easily withdrawn by using simple tools such as pliers to engage the exposed part of the second wire portion. The wire is deflected until its end 72 is in register with the slot 68, whereupon the foot may easily be withdrawn from the slat 52.

Although the mirror image configuration of FIGS. 9–12 is preferred, the spring may also have two halves which are rotated images with respect to each other. In such a rotated image spring, each half of the spring is geometrically identical to its opposite half, one having been rotated 180° about a vertical axis which extends centrally through the spring.

FIGS. 14 and 15 illustrate a modified version of the spring shown in FIG. 9, and they also disclose a deflection limiting device which can be used with springs of this and other types. In this regard, it is mentioned that the deflection limiting device would normally be used in connection with units which have the spring mounted on wooden members rather than hollow metal slats.

Referring to FIG. 14, it will be seen that the spring 80 is similar in most respects to the spring 50 of FIG. 9. The lower portions and midportions are identical. The point of difference is in the upper portion where it will be seen that the modified spring has a center bar formed of two longitudinal sections 82 which are spaced from each other and are connected together by a section of wire which has a third transverse bar 84 therein. This bar 84 is centrally located on the spring and it contributes somewhat to the versatility of the spring, as it is clippable to a longwire of the grid of the bedding unit. Normally, the sections 82 will be clipped to crosswires, but there are some situations where it is desirable to have the centrally located transverse bar available for grid attachment purposes.

Another feature of the embodiment shown in FIGS. 14 and 15 is the utilization of a deflection limiter member 90 which is attached to the spring 80 to limit the collapsing movement of its midportion. This limiter 90 is a piece of wire which has an abutment portion 92 and two connector bars 94 and 96. These connector bars extend from the abutment portion to the spring 80 at different inclination angles, so that the upper connector bar 94 has a greater inclination from the horizontal than the lower connector bar 96. These connector bars 94 and 96 have transverse bars 95 and 97 which are connected to the spring 80 at different elevations. As can be seen in FIG. 15, the abutment portion 92, which is essentially a torsion bar, will move downwardly in response to vertical collapsing movement of the midportion of the spring 80. The collapsing movement of the spring is stopped when the abutment portion 92 contacts the frame or any other object positioned in its path. Preferably, the deflection limiter member 90 also increases the stiffness of the spring, or at least one half thereof. To understand this, reference is made to FIG. 15 which shows the deflection limiter member connected to the torsion bars 54' and 64' on the spring which are spaced apart by a distance which will change in response to vertical collapsing movement of the spring. As can also be seen in FIG. 15, collapsing movement of the spring causes the deflection limiter member to deform. The connector bars of the deflection limiter move relative to each other to decrease the angle between them. This produces torsion in the abutment portion 92 and, due to the resilience of the wire material, this will increase the effective stiffness of the right side of the spring as seen in FIG. 15.

In some situations where smaller springs are desired or acceptable, it is possible to make springs which are only onehalf of springs 50 or 80, each spring having only one foot and having a shortened upper portion which more closely resembles one-half of the upper portion of the spring of FIG. 7. As to the deflection limiter 90, it can be modified so that its connector bars extend to and are connected to any two transverse bars on the main spring, for example, bars which correspond to the bars 54, 58 or 64 shown in FIG. 9.

Persons familiar with the field of the invention will appreciate that it may take many forms other than the preferred embodiments described in this specification. In view of this circumstance, it is emphasized that the invention is not limited only to the disclosed embodiments but is embracing of modifications thereto and variations thereof which fall within the spirit of the following claims.

I claim:

1. A spring for supporting a wire grid on a frame of a bedding unit, said spring being formed of a single resilient wire which has a lower portion connectible to the frame, a substantially horizontal upper portion connectible to the wire grid, and a midportion connecting the lower portion to the upper portion, said midportion being vertically collapsible to support the upper portion resiliently on the lower portion, said wire having both of its ends located in said upper portion, said lower portion comprising a foot which is connectible to the frame, said vertically collapsible midportion of the spring including two lower connector bars which extend outwardly from the foot in opposite directions.

2. A spring according to claim 1 wherein said vertically collapsible midportion includes torsion bars which extend transversely from the lower connector bars, and upper connector bars which extend inwardly from the torsion bars in opposite directions.

3. A spring according to claim 1 wherein the foot is U-shaped.

4. A spring according to claim 1 in combination with a frame for a bedding unit, said frame having slats, said foot of the spring being mounted on said slats.

5. The invention according to claim 4 having a wire grid connected to the upper portion of the spring.

6. The invention according to claim 5 having a plurality of said springs connected to said wire grid and said frame, different said springs having their feet extending in opposite directions so that the attachment of the springs to the grid maintains the feet of the springs in a spaced relationship to prevent their removal from the slats.

7. The invention of claim 1 wherein said upper portion has a pair of transverse bars and a pair of longitudinal bars which can be clipped to a said wire grid, said longitudinal bars being directed toward midportions of the transverse bars, said upper portion also having a pair of connecting sections each of which extends from one end of a center bar to one end of a transverse bar.

8. A spring according to claim 1 wherein said foot has a geometric center which lies at an intersection of a transverse vertical plane and a longitudinal vertical plane, said lower connector bars both extending from the foot on the same side ot said longitudinal vertical plane and on opposite sides of said transverse vertical plane.

9. A spring according to claim 1, said spring having a transverse vertical plane extending centrally therethrough, said spring having halves on opposite sides of said transverse vertical plane which are substantially mirror images of each other.

10. A spring according to claim 1 which is a full deflection spring in the respect that the upper portion is resiliently displaceable to a collapsed postion where it is substantially adjacent to the lower portion, said upper portion being resiliently movable from said collapsed position to its original height.

11. In combination, a spring and a hollow slat having a slot upon which the spring is mounted, for supporting a wire grid on a frame of a bedding unit, said spring being formed of a single resilient wire which has a lower portion connectible to the frame, an upper portion connectible to the wire grid, and a midportion connecting the lower portion to the upper portion, said midportion being vertically collapsible to support the upper portion resiliently on the lower portion, said lower portion of the spring including a foot formed of first and second wire portions which are resiliently connected to each other, said wire portions of the foot being insertable together into said slot in said hollow slat, both of said wire portions of the foot having ends which are trailing ends with respect to the direction of insertion, said trailing end of the first wire portion of the foot having a bend which connects the foot to the vertically collapsible midportion of the spring, said trailing end of the second wire portion of the foot being an end of said wire and having an end surface thereon, said end surface of the wire being located forwardly of said bend with respect to the insertion direction of the foot so that, during insertion, while the first wire portion of the foot is in said slot, the trailing end of the second wire portion passes beyond said slot and moves resiliently outwardly to a position where said end surface confronts an interior surface of the slat to lock the foot in the slat mechanically so that the foot cannot be removed from the slat by forces which are directed opposite to the insertion direction said wire having a bend formed at the trailing end of the first wire portion, said bend providing means for binding the spring in the slot in said hollow slat to limit the insertion of said foot into said slat.

12. The combination according to claim 11 having two said feet located at opposite ends of said resilient wire.

13. The combination according to claim 11 in combination with a frame for a bedding unit, said frame having slats which have slots formed therein, said foot being locked in one of said slots.

14. The combination according to claim 13 having a wire grid connected to the upper portion of the spring.

15. The combination according to claim 14 wherein the slot includes an entry slot and an exit slot, both of said wire portions of the foot being biased resiliently against the ends of the exit slot when the foot is locked in the slat, said first wire portion of the foot being biased against an end of the entry slot when the foot is locked in the slat.

16. The combinations according to claim 11, said spring having a transverse vertical plane extending centrally therethrough, said spring having halves on opposite sides of aid transverse vertical plane which are substantially mirror images of each other.

17. A spring for supporting a wire grid on a frame of a bedding unit, said spring being formed of a single resilient wire which has two ends, said wire having a lower portion connectible to the frame, an upper portion connectible to the wire grid, and a midportion connecting the lower portion to the upper portion, said midportion being vertically collapsible to support the upper portion resiliently on the lower portion, said upper portion being substantially horizontal and including a pair of transverse bars and a longitudinally oriented center bar which is formed of two spaced apart center bar sections each of which includes one of the ends of the wire, and said center bar sections being spaced from said transverse bars and directed toward midportions of the transverse bars, said transverse bars being located between said center bar sections, said upper portion also having connecting sections which each extend from one end of center bar section to one end of a transverse bar.

18. A spring according to claim 17 in combination with a frame for a bedding unit, said frame having slats, said foot of the spring being mounted on said slats.

19. The invention according to claim 18 having a wire grid connected to the upper portion of the spring.

20. The invention according to claim 19 having a plurality of said springs connected to said wire grid and said frame, different said springs having their lower portions provided with feet extending in opposite directions so that the attachment of the springs to the grid maintains the feet of the springs in a spaced relationship to prevent their removal from the slats.

21. A spring according to claim 17 wherein said lower portion includes a foot which is connectible to the frame, said midportion including two lower connector bars which extend outwardly from the foot in opposite directions.

22. A spring for supporting a wire grid on a frame of a bedding unit, said spring being formed of a single resilient wire which has a lower portion connectible to the frame, an upper portion connectible to the wire grid, and a midportion connecting the lower portion to the upper portion, said midportion being vertically collapsible to support the upper portion resiliently on the lower portion, a deflection limiter member attached to the spring to limit the collapsing movement of the midportion of the spring, said deflection limiter member comprising a piece of wire which has an abutment portion and upper and lower connector bars, said connector bars of the deflection member extending from the abutment portion to the spring at different inclination angles and being connected to the spring at different elevations, said upper connector bar having a greater inclination from horizontal than said lower connector bar, said abutment portion being operable to move downwardly relative to the spring in response to vertical collapsing movement of the midportion of the spring so that the collapsing movement of the spring is stopped when the abutment portion contacts an object in its path.

23. The invention according to claim 22, wherein the connector bars of the deflection limiter member are connected to two locations on the spring which are spaced apart by a distance which changes in response to vertical collapsing movement of the spring, said collapsing movement of the spring being operable to deform the deflection limiter member by moving the connector bars of the deflection limiter member relative to each other, said deflection limiter member being resilient to increase the effective stiffness of the spring.

24. A spring for supporting a wire grid on a frame of a bedding unit, said spring being formed of a single resilient wire which has a lower portion connectible to the frame, an upper portion connectible to the wire grid, and a midportion connecting the lower portion to the upper portion, said midportion being vertically collapsible to support the upper portion resiliently on the lower portion, said vertically collapsible midportion including lower connector bars, torsion bars which extend transversely from the lower connector bars, and upper connector bars which extend inwardly from the torsion bars in opposite directions, said wire having both of its ends located in said upper portion, said lower portion including a foot which is connectible to the frame, said midportion having two lower connector bars which extend outwardly from the foot in opposite directions, said upper portion being substantially horizontal and inclinding a pair of transverse bars and a longitudinally oriented center bar which is formed of two spaced apart center bar sections, and said center bar sections being spaced from said transverse bars and directed toward midportions of the transverse bars, said transverse bars being located between said center bar sections, said upper portion also having connecting sections which each extend from one end of a center bar section to one end of a transverse bar.

25. A spring unit for supporting a wire grid on a frame of a bedding unit, said spring being formed of a single resilient wire which has a lower portion connectible to the frame, an upper portion connectible to the wire grid, and a midportion connecting the lower portion to the upper portion, said midportion being vertically collapsible to support the upper portion resiliently on the lower portion, said wire having both of its ends located in said upper portion, said lower portion including a U-shaped foot which is connectible to the frame, said midportion having two lower connector bars which extend outwardly from the foot in opposite directions, said upper portion bring substantially horizontal and including a pair of transverse bars and a longitudinally oriented center bar which is formed of two spaced apart center bar sections, and said center bar sections being spaced from said transverse bars and directed toward midportions of the transverse bars, said transverse bars being located between said center bar sections, said upper portion also having connecting sections which each extend from one end of a center bar section to one end of a transverse bar.

26. A box spring frame member and a spring mounted to said frame member for supporting a wire grid of a bedding unit, said spring being formed of a single resilient wire which has a lower portion connected to the frame, an upper portion connectible to the wire grid, and a midportion connecting the lower portion to the upper portion, said midportion being vertically collapsible to support the upper portion resiliently on the lower portion, 1a deflection limiter member attached to the spring to limit the collapsing movement of the midportion of the spring, said deflection limiter member comprising a piece of wire which has an abutment portion and two connector bars, said connector bars of the deflection limiter member extending from the abutment portion to the spring at different inclination angles and being connected to the spring at different elevations, said abutment portion being operable to move downwardly in response to vertical collapsing movement of the midportion of the spring to a position where the abutment portion contacts the frame member to stop the collapsing movement of the spring.

* * * * *